United States Patent [19]

Kupersmit

[11] 4,167,242

[45] Sep. 11, 1979

[54] CARTON SEAL

[76] Inventor: Julius B. Kupersmit, 148-80 228th St., Springfield Gardens, N.Y. 11413

[21] Appl. No.: 911,372

[22] Filed: Jun. 1, 1978

[51] Int. Cl.[2] ..... B65D 45/00

[52] U.S. Cl. ..... 229/45 R; 229/52 A

[58] Field of Search ..... 229/52 A, 45 R, 46, 229/47, 39 R, 77, 78 R, 78 A, 78 B

[56] References Cited

U.S. PATENT DOCUMENTS

| | | | |
|---|---|---|---|
| 362,675 | 5/1887 | Smith | 229/47 |
| 2,233,799 | 3/1941 | Seifer et al. | 229/52 A |
| 2,250,010 | 7/1941 | Cohn | 229/52 A |
| 3,118,201 | 1/1964 | Beghetto, Jr. | 229/47 X |

FOREIGN PATENT DOCUMENTS

| | | | |
|---|---|---|---|
| 798507 | 3/1936 | France | 229/46 |

*Primary Examiner*—Stephen P. Garbe
*Attorney, Agent, or Firm*—Charles E. Temko

[57] ABSTRACT

A portable carton of the type which is maintained in closed condition by the engagement of a synthetic resinous handle which penetrates an opening in the wall of the lid section of the carton and engages an opening in a wall of the container section. Tabs are cut from the last mentioned wall and extend through openings in the first mentioned wall in the area under the handle. The tabs have openings through the plane thereof, which are engaged by a wire or synthetic resinous seal, whereby no additional material is required to form the means engaging the seal.

2 Claims, 5 Drawing Figures

10
12
13
15
16
23
27
28
30
31
32
33
34
35
36
37
45
46
47
48
49

CARTON SEAL

BACKGROUND OF THE INVENTION

This invention relates generally to the field of merchandising containers suitable for packaging small articles, clothing in folded condition, and similar merchandise, and more particularly to an improved form thereof in which provision has been incorporated to provide for the sealing of the carton to prevent undetected pilfering during such periods when the carton is in the custody of persons other than the purchaser after packing of a purchase has been completed.

While the incorporation of pilfer-proof seals in large containers containing commercial shipments is well-known in the art, such provision normally involves the employment of additional structure incorporated into the main body and lid of such containers, the additional cost of which is amply justified by the value of the shipment, and the fact that the carton is, in many instances, reuseable.

However, in recent years, the problem of pilferage occurring where a shopper checks articles he has already purchased, to be retrieved before completing a shopping expedition has been increasing. On the increase is pilfering occurring in restaurants, or checking facilities in a store and the like.

Part of the problem exists in the fact that normally the design of a package or carton used for merchandising is almost entirely based around parameters of low cost and easy assembly from a flattened condition.

SUMMARY OF THE INVENTION

Briefly stated, the invention contemplates the provision of an improved sealable carton of relatively modest dimensions, in which the sealing structure is in the form of orificed tabs formed upon an inner wall of the closure of the carton, which are bent outwardly to project through openings in an outer wall overlying the inner wall when the carton is in closed condition. Where the carton is provided with a slotted construction accommodating a detachable flexible handle, usually of synthetic resinous materials, the tabs may be disposed beneath the handle, so that the seal does not project outwardly thereof.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figures 1, 2, 4:
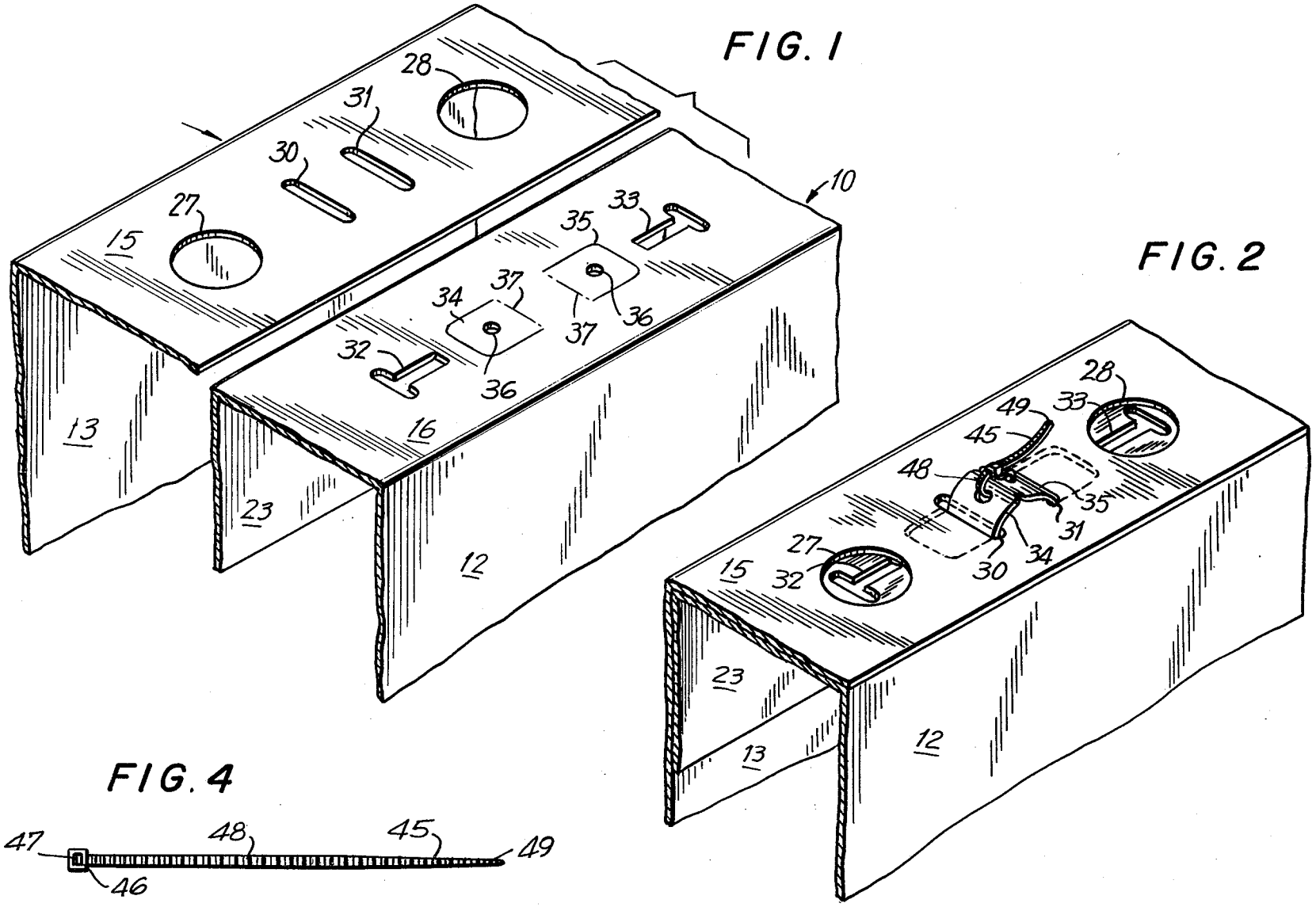
FIG. 1 is a fragmentary view in perspective of an embodiment of the invention showing the same in opened condition.
FIG. 2 is a fragmentary view in perspective of an embodiment of the invention, showing the same in closed condition with a seal in position.
FIG. 4 is a view in elevation of a synthetic resinous seal element.
Figure 5:
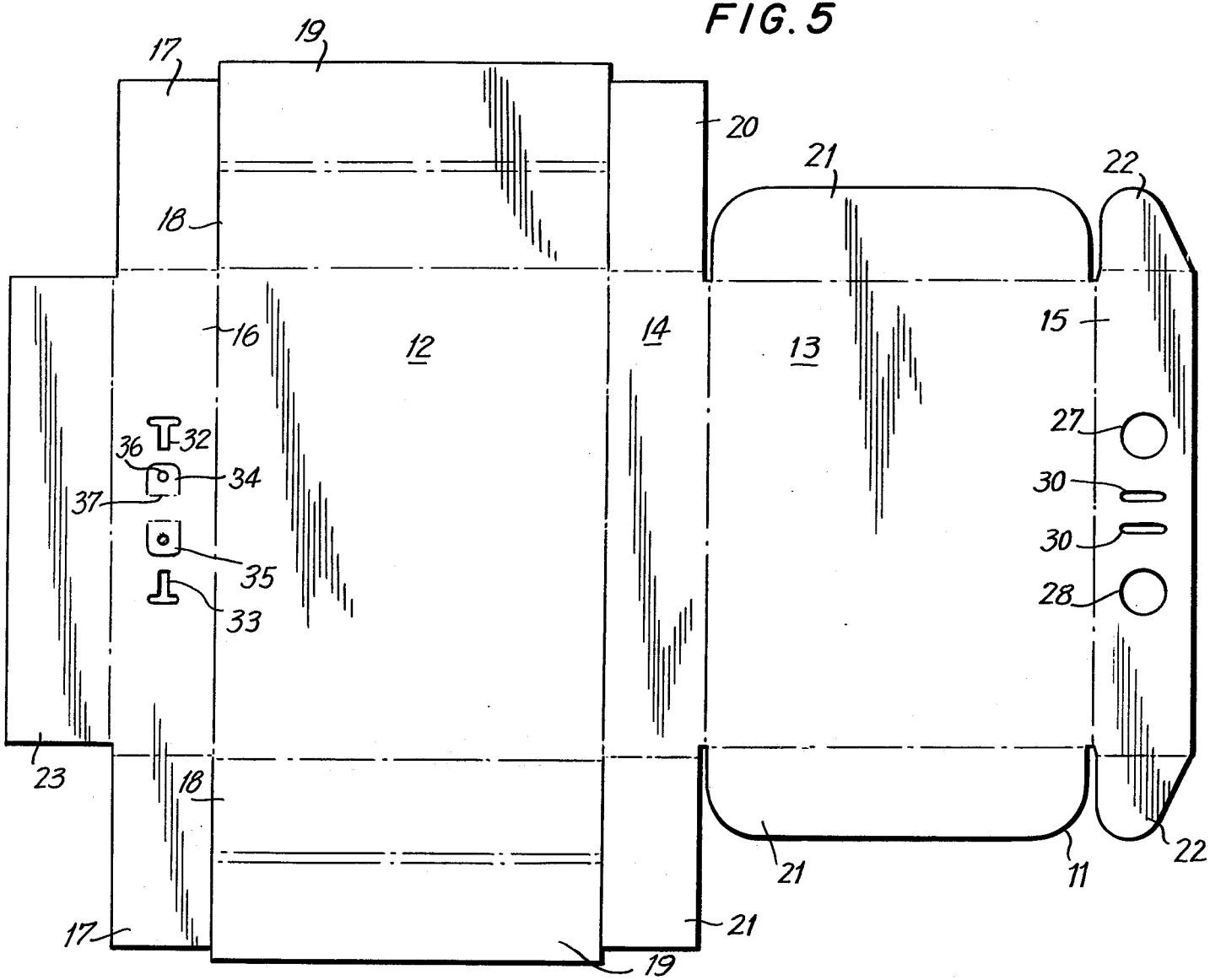
FIG. 5 is a view in elevation of a developed blank from which the embodiment is formed.
Figure 3:
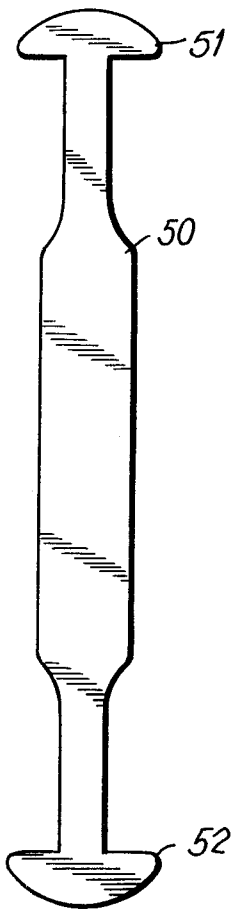
FIG. 3 is a view in elevation of a flexible handle element comprising a part of the embodiment.

In accordance with the invention, the device, generally indicated by reference character 10, is formed from a unitary blank 11 of cardboard or similar material in a manner well known in the art. The blank includes first and second main walls 12 and 13, respectively, and interconnecting side wall 14, overlying side walls 15 and 16, and pairs of peripheral flaps 17, 18, 19, 20, 21 and 22. A reinforcing end flap 23 adds thickness to what ultimately becomes the upper wall of the carton when the same is carried.

The side wall 15 forms ultimately the outer laminar of the upper wall, and is provided with first and second circular openings 27 and 28 and first and second elongated openings 30. The side wall 16 is configured to be placed in congruity with the wall 15, and is provided with first and second T-shaped openings 32 and 33, as well as first and second bendable tabs 34 and 35 disposed therebetween, each of the tabs being provided with a through orifice 36 and a fold line 37, permitting the same to be bent at right angles with respect to the plane of the wall.

During assembly, the wall 16 and 17 as well as flaps 17-23, inclusive, are inwardly folded about the main walls 12 and 13, following which the main walls are placed in parallel relation. The flaps 22 form a locking means tending to hold the carton in closed condition after merchandise has been packed therein.

Next the tabs 34 and 35 are bent outwardly to project through the openings 29 and 30.

At this point, the orifices 36 are engaged by a synthetic resinous seal 45 having an orificed terminal 46 incorporating a deflectable latch 47 which is adjustably engageable with the serrated surface 48 of an elongated tongue 49. This type of seal is known in the art, although it is normally employed for closing the openings of polyethylene bags and the like, and is of such construction that once closed, it cannot be opened without severing or materially damaging the same.

When the seal has been engaged, a flexible handle 50 of known type having enlarged terminals 51 and 52 is engaged with the openings 32 and 33 in well-known manner to complete the package for carrying.

The carton may be allowed to remain in this condition until the shopper reaches home at the end of a shopping excursion. Should for any reason it be necessary to check the carton, upon its retrieval, any tampering with the seal will be immediately noticed by the purchaser, and appropriate action taken.

It may thus be seen that I have intended novel and highly useful improvements in shopping cartons which afford means for sealing the same at the point of purchase until such time as a shopper arrives at his residence. The sealing provides immediate notice to the shopper if any pilferage has occurred or whether the seal has been tampered with immediately upn its retrieval which, for practical purposes, tends to discourage pilfering. The structure supporting the seal may be cut directly from the blank forming the carton, at practically no additional cost to manufacture, and the seal employed is one known in the art which is readily available at reasonable cost.

I wish it to be understood that I do not consider the invention limited to the precise details of structure shown and set forth in this specification, for obvious modifications will occur to those skilled in the art to which the invention pertains.

I claim:

1. In a portable carton of the type which is maintained in closed condition by the engagement of a flexible handle having enlarged ends penetrating openings in an outer wall and engaging non-circular openings in an inner wall disposed there beneath, the improvement comprising: said inner wall having a plurality of orificed bendable tabs cut from the plane of said inner wall and disposed substantially at right angles with respect to the plane thereof; said outer wall having corresponding openings therein, positioned to overlie said tabs when said carton is in closed condition, said tabs projecting through said last mentioned opening; and a frangible seal penetrating the orifices in said tabs to lock said carton in closed condition.

2. The improvement in accordance with claim 1, further comprising: said seal being a unitary molding of synthetic resinous material and having an elongated tongue and an orificed terminal member at one end thereof, including a locking ratchet, said tongue having continuous serrations on at least one surface thereof, adjustably engaged with said ratchet.

* * * * *